United States Patent [19]

Itoh et al.

[11] 4,211,276

[45] Jul. 8, 1980

[54] METHOD OF MAKING FIN ELEMENTS FOR HEAT EXCHANGERS

[75] Inventors: Masaaki Itoh, Tsuchiura; Tsuneyoshi Takasuna, Hitachi; Yuichi Ishikawa, Sakuramura; Hideyuki Kimura, Chiyodamura; Masanori Musoh, Katsuta, all of Japan

[73] Assignee: Hitachi, Ltd., Japan

[21] Appl. No.: 918,274

[22] Filed: Jun. 22, 1978

[30] Foreign Application Priority Data

Jun. 29, 1977 [JP] Japan ..... 52-76511

[51] Int. Cl.[2] ..... F28F 13/18

[52] U.S. Cl. ..... 165/1; 29/157.3 R; 165/133

[58] Field of Search ..... 165/133, 181, 1; 29/157.3 R

[56] References Cited

U.S. PATENT DOCUMENTS

| | | | |
|---|---|---|---|
| 1,578,254 | 3/1926 | Bennett | 165/133 |
| 3,154,141 | 10/1964 | Huet | 165/133 |
| 3,207,209 | 9/1965 | Hummel | 165/133 |
| 3,613,779 | 10/1971 | Brown | 165/133 |
| 3,722,229 | 3/1973 | Kayahara et al. | 165/133 |

FOREIGN PATENT DOCUMENTS

| | | | |
|---|---|---|---|
| 48-24451 | 7/1973 | Japan | 165/181 |
| 51-95649 | 8/1976 | Japan | 165/133 |
| 52-131247 | 11/1977 | Japan | 165/133 |
| 257457 | 11/1969 | U.S.S.R. | 165/133 |

*Primary Examiner*—Sheldon Richter

*Attorney, Agent, or Firm*—Craig & Antonelli

[57] ABSTRACT

In a crossed fin-tube type heat exchanger wherein tubes are attached at right angles to a large number of fin elements arranged in parallel with one other, the surfaces of these fin elements are roughened to have an unevenness satisfying a relation $$R \approx 1/\cos\theta$$

where R is a ratio of the extended, uneven or roughened surface to the flat or smooth surface of the fin element; and $\theta$ is a contact angle for a liquid droplet in contact with the flat or smooth surface of the fin element.

9 Claims, 5 Drawing Figures

METHOD OF MAKING FIN ELEMENTS FOR HEAT EXCHANGERS

LIST OF PRIOR ART REFERENCES (37 CFR 1.56 (a))

The following references are cited to show the state of the art:

Japanese Patent Publication No. 24451/73,

Japanese Patent Application Kokai (Laid-Open) No. 95649/76,

Japanese Patent Application Kokai (Laid-Open) No. 131247/77.

The above Japanese Patent Publication No. 24451/73, discloses fin elements for heat exchangers wherein fine unevenness are formed on the surfaces of the fin elements so that water may adhere to the fin elements in diffused state. The above Japanese Kokai No. 95649/76, teaches that the surface roughness for fin elements is less than 35 microns. The above Japanese Kokai No. 131247/77, teaches that the surface roughness for fin elements are between 15 and 20 microns and the surfaces of the louvre-like projections struck out from the fin elements are formed with unevenness between 15 and 20 microns.

The concept common in the above publications resides in that in order to prevent any adhesion of semispherical-shaped liquid droplets to the surfaces of the fin elements, that is, to improve the dripping characteristic of the fin elements, the surfaces thereof are roughened to the surface roughness less than 35 microns and that the surface roughness is determined by the results of experiments in which liquid droplets are adhered to or made into contact with the fin elements.

The dripping characteristics is influenced by various factors such as qualities of materials of the fin elements, types of liquids made into contact with the fin elements, combinations of the fin element materials and the types of liquids made into contact therewith, surface treatment for the fin elements, types of surface treatment and so on. Therefore the methods disclosed in the above publications for determining the surface roughness of the fin elements can be determined only after repeated trial production of fin elements and evaluation of their dripping characteristics. Thus the prior art methods are very cumbersome, uneconomical and low in productivity.

FIELD OF THE INVENTION

The present invention relates to fin elements for heat exchangers used in automotive and room or household unitary air-cooling equipment, packaged air conditioners and dehumidifiers wherein vapor condenses on the surfaces of the fin elements to cause liquid droplets to be adhered thereto, and for heat exchangers used in refrigerators, show cases and heat pumps wherein frost adheres to the surfaces of the fin elements.

SUMMARY OF THE INVENTION

It is an object of the present invention to provide fin elements for heat exchangers which exhibit better dripping characteristics, that is, property that liquid droplets adhering to the surfaces of the fin elements may drip off quickly and which may be manufactured at less cost.

Another object of the present invention is to provide fin elements for heat exchangers which exhibit better dripping characteristics and improved anticorrosiveness.

A further object of the present invention is to provide fin elements for heat exchangers which are adapted for multikind and small quantity production or multikind and large quantity production.

The above objects of the present invention can be attained by fin elements for heat exchangers of the type having liquid droplets and/or frost adhered to the surfaces of the fin elements wherein the surfaces of the fin elements are roughened such that surface roughness thereof satisfies the following relation $$R \approx 1/\cos\theta$$

where

R; ratio of the extended uneven or roughened surface area Ac of the fin element to the flat or smooth surface area As of the fin element before its surface is roughened; and $\theta$; contact angle of a liquid droplet in contact with the surface of the fin element.

DETAILED DESCRIPTION OF THE PREFERRED EMBODIMENT

According to the present invention, the surfaces of the fin elements are roughened to have such uneveness as to satisfy the following relation $$R \approx 1/\cos\theta$$

where

R; ratio of the extended uneven or roughened surface area of the fin element to the flat or smooth surface thereof prior to the surface roughening step as defined above, and this ratio will be referred to as "coefficient of surface roughness" in this specification; and $\theta$; contact angle for a liquid droplet in contact with the flat or smooth surface of the fin element.

The unevenness on the surfaces of the fin elements are typically wave-shaped or triangular-shaped or similarly shaped in cross section. And the uneveness are innumerably distributed over the surfaces of the fin elements. The pitch of the unevenness is selected to be smaller than the maximum diameter of any liquid droplet in contact with the fin elements.

Figure 1:
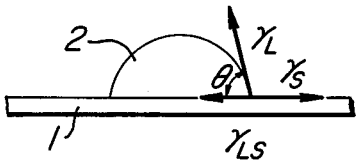
FIG. 1 is a schematic side view of a flat or smooth fin element having a liquid droplet adhered thereto and showing a relation between the surface tension and contact angle for the droplet.

FIG. 1 shows a liquid droplet 2 in contact with a flat or smooth surface of a fin element 1. As is well known in the art, at equilibrium the surface tension and contact angle satisfy the following relation;

$$\gamma_{LS} + \gamma_L \cdot \cos\theta - \gamma_S = 0 \quad (1)$$

where $\gamma_S$; surface tension of the solid, that is, the fin element;

$\gamma_L$; surface tension of the liquid;

$\gamma_{LS}$; boundary tension between the liquid and solid; and $\theta$; contact angle.

Figure 2:
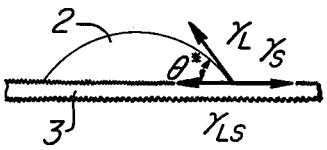
FIG. 2 is a schematic side view of a roughened fin element having a liquid droplet adhered thereto and showing a relation between the surface tension and contact angle for the droplet.

However, when liquid droplet 2 is in contact with the uneven or roughened surface of a fin element 3 as shown in FIG. 2, the following relation holds good;

$$R(\gamma_{LS}-\gamma_S)+\gamma_L\cdot\cos\theta^*=0 \quad (2)$$

where

R; coefficient of surface roughness (that is, extended uneven or roughened surface area/flat or smooth surface area; and $\theta^*$; contact angle of droplet 2 on the uneven or roughened surface of the fin element 3. From Eqs. (1) and (2), $$\cos\theta^*=R\cos\theta \quad (3)$$

Figure 3:
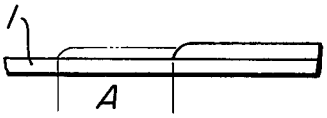
FIG. 3 is a schematic side view of a flat or smooth fin element having a liquid film thereon.
Figure 4:
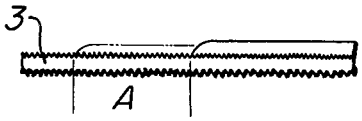
FIG. 4 is a schematic side view of an uneven or roughened fin element having a liquid film thereon.

FIGS. 3 and 4 show how liquid droplets on the surface of the fin element make liquid film. Liquid on the flat or uneven surface as indicated by the solid lines in FIGS. 3 and 4 spreads thereover as indicated by the dotted lines. In other words, energy $G_2$ of liquid after spreading is smaller than energy $G_1$ thereof prior to spreading.

In the case of a flat or smooth fin element (1), these energies $G_1$ and $G_2$ are given by $$G_1=A\cdot\gamma_S \quad (4)$$

$$G_2=A\cdot\gamma_{LS}+A\cdot\gamma_L \quad (5)$$

where A; area of a surface portion covered by liquid.

The condition under which liquid droplets make film is $G_2-G_1\leqq 0$, as described hereinabove. Accordingly, substituting Eqs. (4) and (5) in the above condition makes $$G_2-G_1=A\cdot\gamma_{LS}+A\cdot\gamma_L-A\cdot\gamma_S\leqq 0 \quad (6)$$

The energy difference per unit area is given by $$(G_2-G_1)/A=\gamma_{LS}+\gamma_L-\gamma_S\leqq 0 \quad (7)$$

Eqs. (1) and (7) makes $$\frac{G_2-G_1}{A}=\gamma_L(1-\cos\theta)\leqq 0 \quad (8)$$

$$\therefore\frac{G_2-G_1}{A\cdot\gamma_L}=1-\cos\theta\leqq 0$$

Since $-1\leqq\cos\theta\leqq+1$, it is found that liquid droplets make film only when $\theta=0°$.

In case of a fin element (3) having an uneven or roughened surface, $$G_1=A\cdot R\cdot\gamma_S \quad (9)$$

$$G_2=A\cdot R\cdot\gamma_{LS}+A\cdot\gamma_L \quad (10)$$

The condition under which liquid droplets make film is $G_2-G_1\leqq 0$, as described above, so that substituting Eqs. (9) and (10) into this condition makes $$(G_2-G_1)/A=R(\gamma_{LS}-\gamma_S)+\gamma_L\leqq 0 \quad (11)$$

Eqs. (2) and (11) makes $$\frac{G_2-G_1}{A}=\gamma_L(1-\cos\theta^*)\leqq 0 \quad (12)$$

$$\therefore\frac{G_2-G_1}{A\cdot\gamma_L}=(1-\cos\theta^*)\leqq 0$$

Substituting Eq. (3) into Eq. (12) makes $$\frac{G_2-G_1}{A\cdot\gamma_L}=1-R\cos\theta\leqq 0 \quad (13)$$

Since $\cos\theta$ ranges from $-1$ to $+1$ and $\cos\theta$ is multiplied by R, it is possible that liquid droplets make film when $\cos\theta>0$.

While liquid droplets adhered to the surface of a fin element 3 make film when the equation (13) holds good, R becomes minimum the condition (13) when $$1-R\cos\theta=0.$$

Therefore, $$R\approx 1/\cos\theta \quad (14)$$

Figure 5:
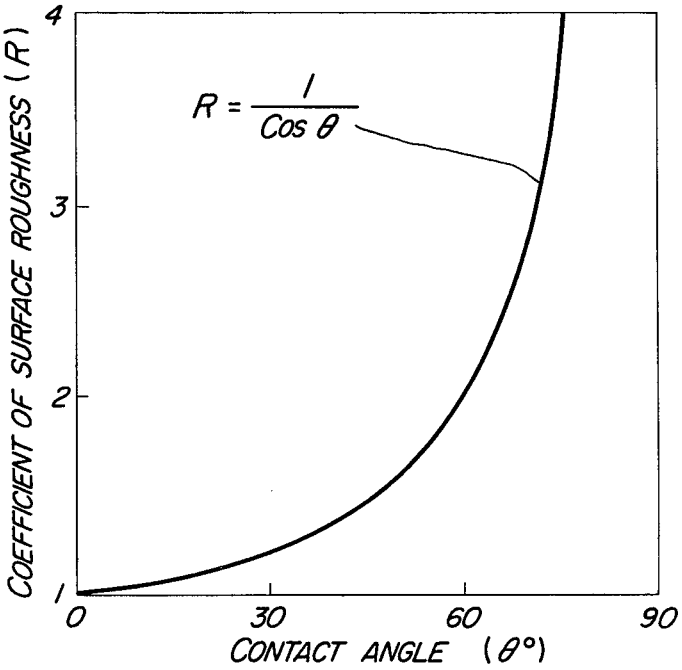
FIG. 5 is a graph showing the relation between the coefficient of surface roughness and contact angle.

FIG. 5 shows the relation represented by the above equation (14). When $(1-R\cos\theta)$ is slightly greater than zero, liquid can not remain in the form of droplets (in the semispherical shape). Therefore, even under the condition $$R=1/\cos\theta \quad (15)$$

the uneven or roughened surface of a fin element (3) has a capability of causing liquid adhered thereto to make film. The lower limit R' of the coefficient of surface roughness expected to cause liquid adhered thereto to make film is estimated to range from 0.9R to 0.95R, that is, to be lower (by 10 to 5%) than the coefficient of surface roughness R obtained from Eq. (14).

The coefficient of surface roughness at which liquid makes film depends upon the quality of material for fin elements, types of liquid and the like. Even if an uneven or roughened fin element has a coefficient of surface roughness higher than that required for causing liquid to spread in the form of a film, the liquid spreading ability almost remains unchanged. Therefore, no upper limit for the coefficient of surface roughness exists. However, in order to provide at lower cost uneven or roughened fin elements for use with heat exchangers, the upper limit R'' for the coefficient of surface roughness is preferably from 1.05R to 1.10R, that is, 5 to 10% higher than R obtained from Eq. (14).

In case of fin elements with uneven or roughened surfaces which have been subject to surface treatment, a coefficient of surface roughness R to cause liquid to make film can be obtained by substituting a contact angle $\theta$ into Eq. (14), which contact angle $\theta$ is determined by measurement on liquid adhered to a flat or smooth surface of a fin element after surface treatment.

The surfaces of the fin element are roughened so as to have a coefficient of surface roughness 1.1R to 0.9R.

Next one embodiment of the present invention will be described. In order to improve corrosion resistance, the latest evaporators are provided having fin elements thereof subjected to surface treatment with chromic acid. Immediately after this surface treatment is effected, the aluminum surface becomes hydrophilic, but it is soon coated with the hard and strong coating to protect aluminum. However, a contact angle for such treated surface is about 70° and water droplets (in the form of a semisphere) remain on the surface to provide poor dripping characteristic.

In order to overcome this problem, the surfaces of fin elements are first roughened to have a coefficient of surface roughness of 2.9, which value satisfies $R \approx 1/\cos 70°$. Thereafter the fin elements are subjected to surface treatment with chromic acid. In order to roughen the surfaces of the fin elements, they are passed through a pair of rolls the surfaces of which are roughened to have a coefficient of surface roughness R of 2.9. Before the resulting roughened surfaces are subjected to surface treatment with chromic acid, they are completely hydrophilic to exhibit excellent dripping characteristics. Since the surfaces of the fin elements are roughened, they are increased in surface area and retain residual stresses to exhibit poor corrosion resistance as compared with fin elements having flat or smooth surfaces. For this reason, the fin elements are subjected to surface treatment with chromic acid so as to have corrosion resisting coatings. The thickness of the coating is, however, very thin or negligible as compared with the unevenness of surface, so that the latter remains almost unchanged. As the result of the surface treatment, the contact angle becomes about 70° with the coefficient of surface roughness of 2.9. Accordingly, liquid droplets tend to become filmy and smoothly flow down over the surfaces of the fin elements. As a consequence, draft resistance may be decreased by about 30% and the performance of the evaporators may be remarkably improved.

In addition to the method for roughening the surfaces of the fin elements by rolling, any other known methods such as sand blasting may be employed.

As described above, according to the present invention the coefficient of surface roughness for surfaces of fin elements is defined to be represented by about $1/\cos\theta$. Uneven or roughened fin elements over which liquid may flow down in the form of film can be provided in a simple and economical manner only by the measurement of contact angle for a liquid droplet on a flat or smooth surface of the fin element. The present invention is particularly advantageous in fin elements having roughened surfaces which have been subjected to surface treatment.

What is claimed is:

1. A method of making a fin element for use in a heat exchanger which in use is contacted on its surface by a specific liquid medium, comprising:

selecting sheet material, placing droplets of said liquid medium on an unroughened surface of said sheet material, determining the contact angle $\theta$ which said droplets make with reference to the plane of the unroughened surface, roughening the surface of the sheet material to have a coefficient of surface roughness R which is approximately equal to an amount $1/\cos\theta$, in which R is a ratio of surface area of the fin element after and before roughening, and $\theta$ is a contact angle of a liquid droplet formed from said liquid medium which adheres to the surface of the fin element sheet material before roughening.

2. A method according to claim 1, wherein the pitch of the roughness is selected to be smaller than the diameter of a liquid droplet of said liquid medium on the surface of the fin element sheet material before roughening.

3. A method according to claim 2, wherein said amount of $1/\cos\theta$ is between 0.9R and 1.1R.

4. A method according to claim 2, wherein said amount of $1/\cos\theta$ is between 0.95R and 1.05R.

5. A method of making a fin element for use in a heat-exchanger which in use is contacted on its surface by a specific liquid medium, comprising:

selecting sheet material, selecting a coating to cover the surface of the sheet material, placing droplets of said liquid medium on an unroughened surface of said sheet material having said coating thereon, determining the contact angle $\theta$ which said droplets make with reference to the plane of the unroughened surface of said coating, roughening the surface of the sheet material without said coating to have a coefficient of surface roughness R which is approximately equal to an amount $1/\cos\theta$ in which R is a ratio of surface area of the fin element after and before roughening, and $\theta$ is a contact angle of a liquid droplet formed from said liquid medium which adheres to the unroughened surface of said sheet material with said coating, and applying said coating to said roughened surface in a layer that is very thin as compared with the unevenness of the roughened surface of the sheet material.

6. A method according to claim 5, wherein the pitch of the roughness is selected to be smaller than the diameter of the liquid droplet of said liquid medium on unroughened surface of said sheet material with said coating.

7. A method according to claim 6, wherein said amount of $1/\cos\theta$ is between 0.9R and 1.1R.

8. A method according to claim 6, wherein said amount of $1/\cos\theta$ is between 0.95R and 1.05R.

9. A method according to claim 6, wherein said coating is anti-corrosive.

* * * * *